US006027307A

United States Patent [19]

Cho et al.

[11] Patent Number: 6,027,307

[45] Date of Patent: Feb. 22, 2000

[54] FAN AND SHROUD ASSEMBLY ADOPTING THE FAN

[75] Inventors: Kyung-seok Cho; Jong-yeol Kim; Tae-young Park; Ki-hyo Kim, all of Taejon, Rep. of Korea

[73] Assignee: Halla Climate Control Corporation, Taejon, Rep. of Korea

[21] Appl. No.: 09/090,846

[22] Filed: Jun. 4, 1998

[30] Foreign Application Priority Data

Jun. 5, 1997 [KR] Rep. of Korea ..... 97-23377

[51] Int. Cl.[7] ..... F01D 5/12

[52] U.S. Cl. ..... 415/173.5; 415/173.6; 415/228; 415/119; 416/169 A; 416/189; 416/192; 416/195

[58] Field of Search ..... 415/119, 173.5, 415/173.6, 228, 211.1, 211.2; 416/189, 192, 169 A, 195

[56] References Cited

U.S. PATENT DOCUMENTS

| | | | |
|---|---|---|---|
| 3,028,072 | 4/1962 | Atalla | 416/198 R |
| 4,329,946 | 5/1982 | Longhouse | 123/41.49 |
| 5,326,225 | 7/1994 | Gallivan et al. | 416/179 |
| 5,423,660 | 6/1995 | Sortor | 416/189 |
| 5,489,186 | 2/1996 | Yapp et al. | 415/58.7 |

FOREIGN PATENT DOCUMENTS

| | | |
|---|---|---|
| 62-10291 | 1/1987 | Japan . |
| 62-152098 | 9/1987 | Japan . |

*Primary Examiner*—Edward K. Look
*Assistant Examiner*—Ninh Nguyen
*Attorney, Agent, or Firm*—Leydig, Voit & Mayer, Ltd.

[57] ABSTRACT

A fan includes a hub coupled to a driving shaft of a motor, a plurality of blades installed on the outer circumferential surface of the hub to be spaced from each other at a predetermined interval, and a band connecting free ends of the blades. An axial direction width (W1) between a leading edge and a trailing edge at the free end of each of the blades is greater than a width (W2) of the band.

6 Claims, 8 Drawing Sheets

FAN AND SHROUD ASSEMBLY ADOPTING THE FAN

BACKGROUND OF THE INVENTION

1. Field of the Invention

The present invention relates to a fan having edge portions of blades connected by a band, and a shroud assembly adopting the fan.

2. Description of the Related Art

As shown in FIG. 1, a conventional fan 10 includes a hub 11 coupled to a driving shaft of a motor or engine and a plurality of blades 12 formed on the outer circumferential surface of the hub 11 spaced apart from each other at equal intervals. A shroud 20 includes a housing portion 21 for housing the fan 10 and a plurality of stators 23 supported by the housing portion 21 and connecting to a motor support portion 22.

In the operation of the above fan-shroud assembly, as the fan 10 rotates, airflow is generated since the blades 12 are disposed at an angle with respect to the driving shaft. Here, the airflow generated by the blades 12 has two directional components, that is, an axial component and a radial component. The radial component gradually increases from the center of the fan 10 toward the free end of each blade 12. Accordingly, at around the edge of the fan 10, airflow directs outward along the radius direction and thus collides against the inner surface of the housing portion 21 of the shroud 20, which acts as a resistance force reducing the airflow efficiency of the fan 10. Such a resistance force not only lowers the efficiency of the fan 10 but also causes noise.

Also, the noise is usually generated around the free end of the respective blades 12 while the fan 10 rotates. That is, when the fan 10 rotates at high speed, air around the free end of each blade 12 flows from a positive pressure surface toward a negative pressure surface, generating a vortex. The vortex increases with increments of a centrifugal force of the airflow as the fan 10 rotates more rapidly. The vortex interfering with the housing portion 21 of the shroud 20 encompassing the fan 10 generates interference noise increasing the blade passing frequency (BPF: the number of rotations of the fan×the number of blades/60).

To solve the above problems, a solution to reduce the noise by forming a portion of a leading edge of the free end of the blade to protrude toward the upper stream in an axial direction with respect to the housing has been introduced. However, the interference noise generated by the housing of the shroud remains at a trailing edge portion of the free end of the blade.

Also, to reduce such noise, a band 13 connecting each free end of the blades 12 has been provided as shown in FIG. 2. In such a case, the width of the free end of the blade 12, i.e., the chord length, cannot be increased due to limitations in the width of the band 13. Therefore, reduction of noise cannot be achieved by increasing the chord length.

SUMMARY OF THE INVENTION

To solve the above problems, it is an objective of the present invention to provide a fan having an improved structure so that noise generated at the free end of a blade during driving of the fan is efficiently reduced and the airflow efficiency of the fan increases, and a shroud assembly adopting the above fan.

Accordingly, to achieve the above objective, there is provided a fan including a hub coupled to a driving shaft of a motor, a plurality of blades installed on the outer circumferential surface of the hub to be spaced from each other at a predetermined interval, and a band connecting free ends of the blades, in which an axial direction width (W1) between a leading edge and a trailing edge at the free end of each of the blades is greater than a width (W2) of the band.

Here, it is preferable in the present invention that the relationship between the axial direction-width (W1) and the band-width (W2) is about $0.5W1 \leqq W2 < 1.0W1$, and more preferably that the relationship between the axial direction-width (W1) and the band-width (W2) is about $0.6W1 \leqq W2 < 0.8W1$.

Also, it is preferable in the present invention that the band is coupled to the trailing edge of the free end of the blade and the leading edge of the free end protrudes from the band.

Further, it is preferable in the present invention that the fan further comprises a flange extending outward from a circumferential portion of the band at an air inflow side or an air outflow side.

According to another aspect of the present invention, there is provided a shroud assembly including a driving motor, a fan having a hub coupled to a driving shaft of a motor, a plurality of blades installed on the outer circumferential surface of the hub to be spaced from each other at a predetermined interval, and a band connecting free ends of the blades, and a shroud supporting the driving motor and having a housing portion for housing the blades and the band, in which an axial direction-width (W1) between a leading edge and a trailing edge at the free end of each of the blades is greater than a width (W2) of the band.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
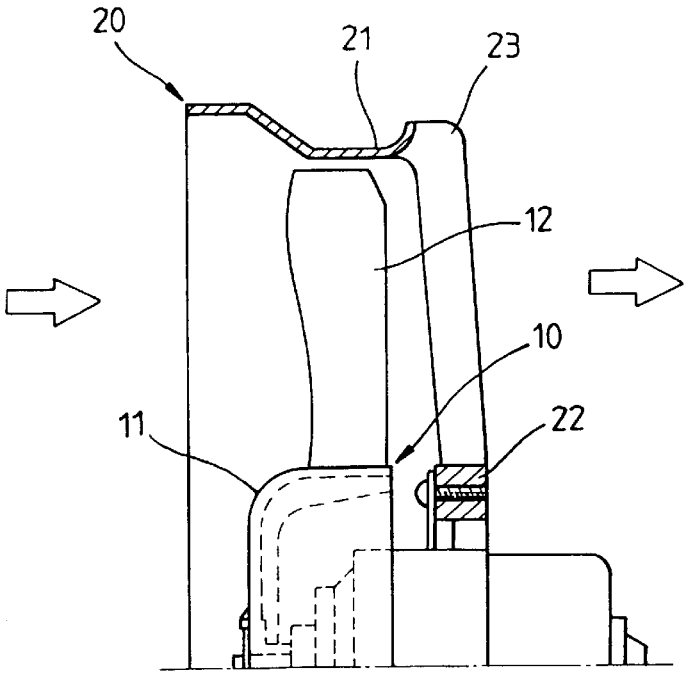
FIG.1 (PRIOR ART)
FIG. 1 is a sectional view illustrating a shroud assembly adopting a fan according to conventional technology.
Figure 2:
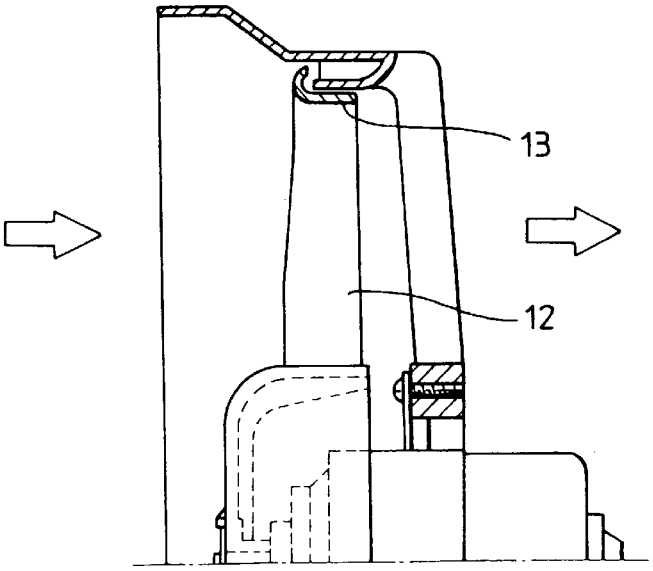
FIG.2 (PRIOR ART)
FIG. 2 is a sectional view illustrating a shroud assembly adopting a fan according to another conventional technology.
Figure 3:
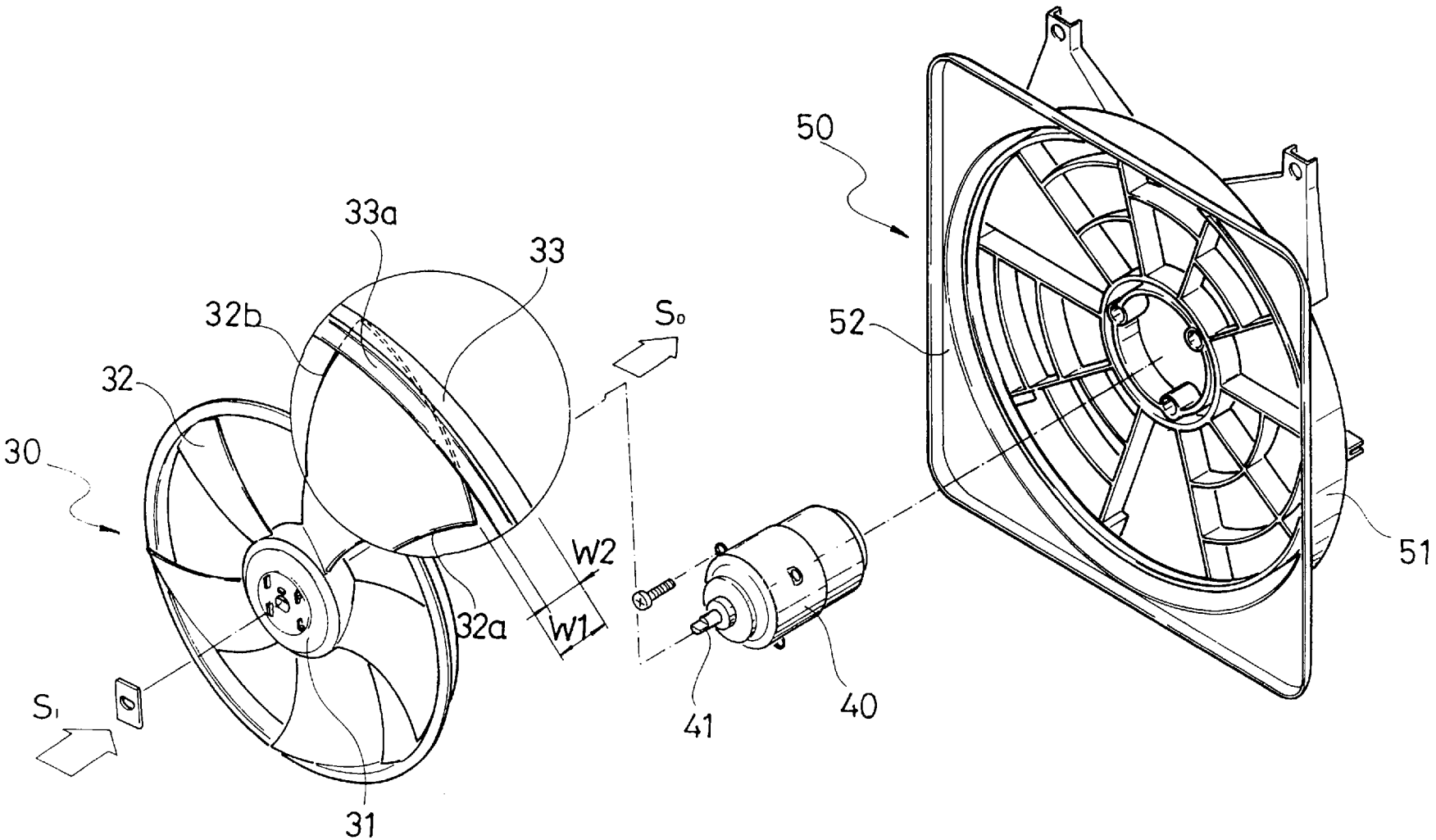
FIG. 3 is an exploded perspective view illustrating a shroud assembly adopting a fan according to a preferred embodiment of the present invention.
Figure 4:
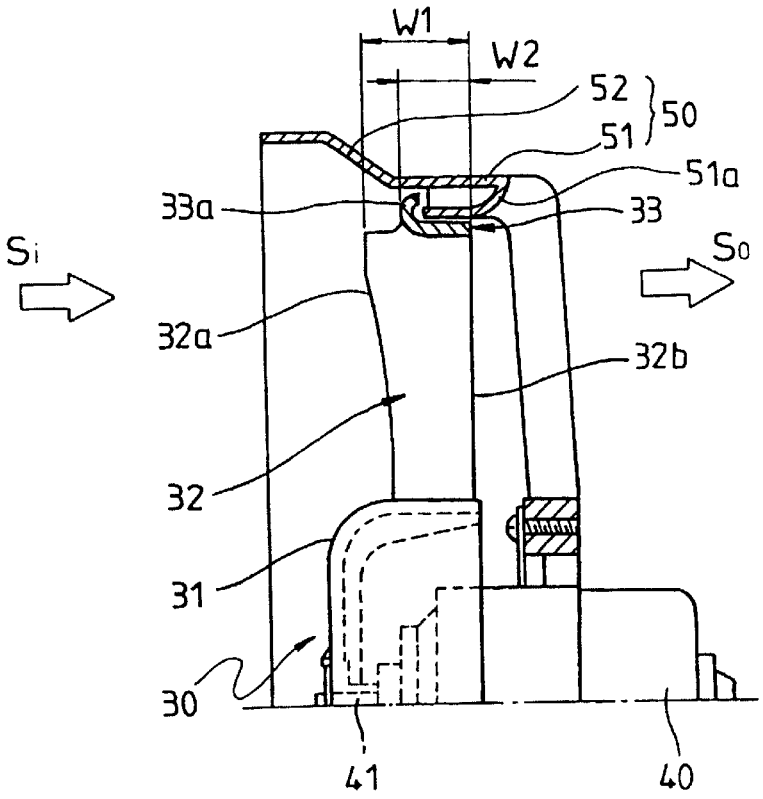
FIG. 4 is a sectional view illustrating the shroud assembly shown in FIG. 3.

FIGS. 3 and 4 show a fan and a shroud according to a preferred embodiment of the present invention.

Referring to the drawings, the shroud assembly of the present invention includes a fan 30 generating airflow, a motor 40 for rotating the fan 30, and a shroud 50 for restricting the backflow of air by encompassing the fan 30.

The fan 30 has a hub 31 coupled to a driving shaft 41 of the motor 40 and a plurality of blades 32 are installed on the outer circumferential surface of the hub 31 at equal intervals. Here, each of the blades 32 is formed to be disposed at an angle with respect to the driving shaft 41 such that a leading edge 32*a* of the blade 32 is disposed toward the air inflow side (Si) and a trailing edge 32*b* thereof is disposed toward the air outflow side (So).

Also, free ends of the blades 32 are connected by a band 33. According to the characteristic feature of the present invention, the width W1 in the axial direction between the leading edge 32*a* and the trailing edge 32*b* at the free end of each blade 32 is greater than a width W2 of the band 33. Thus, at the free end of the respective blades 32, the leading edge 32*a* is coupled to the band 33 to protrude from the band 33 while the trailing edge 32*b* is coupled to the band 33 within the band-width W2.

Here, the band-width W2 is preferably set within a range of $0.5W1<W2<1.0W1$. According to experiments by the applicant, a range of $0.6W1<W2<0.8W1$ provided the best performance.

Figure 7:
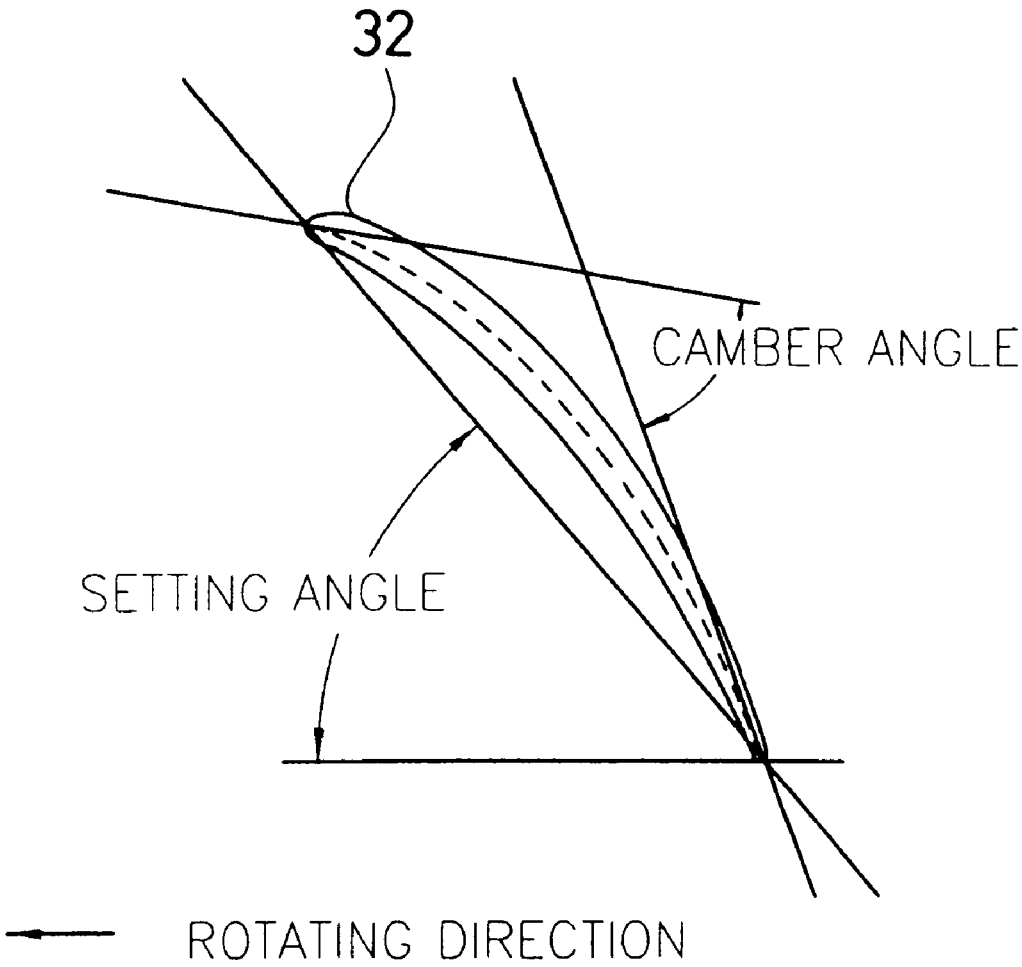
FIG. 7 is a view showing the definitions of a camber angle and a setting angle of a free end of a blade.
Figure 8:
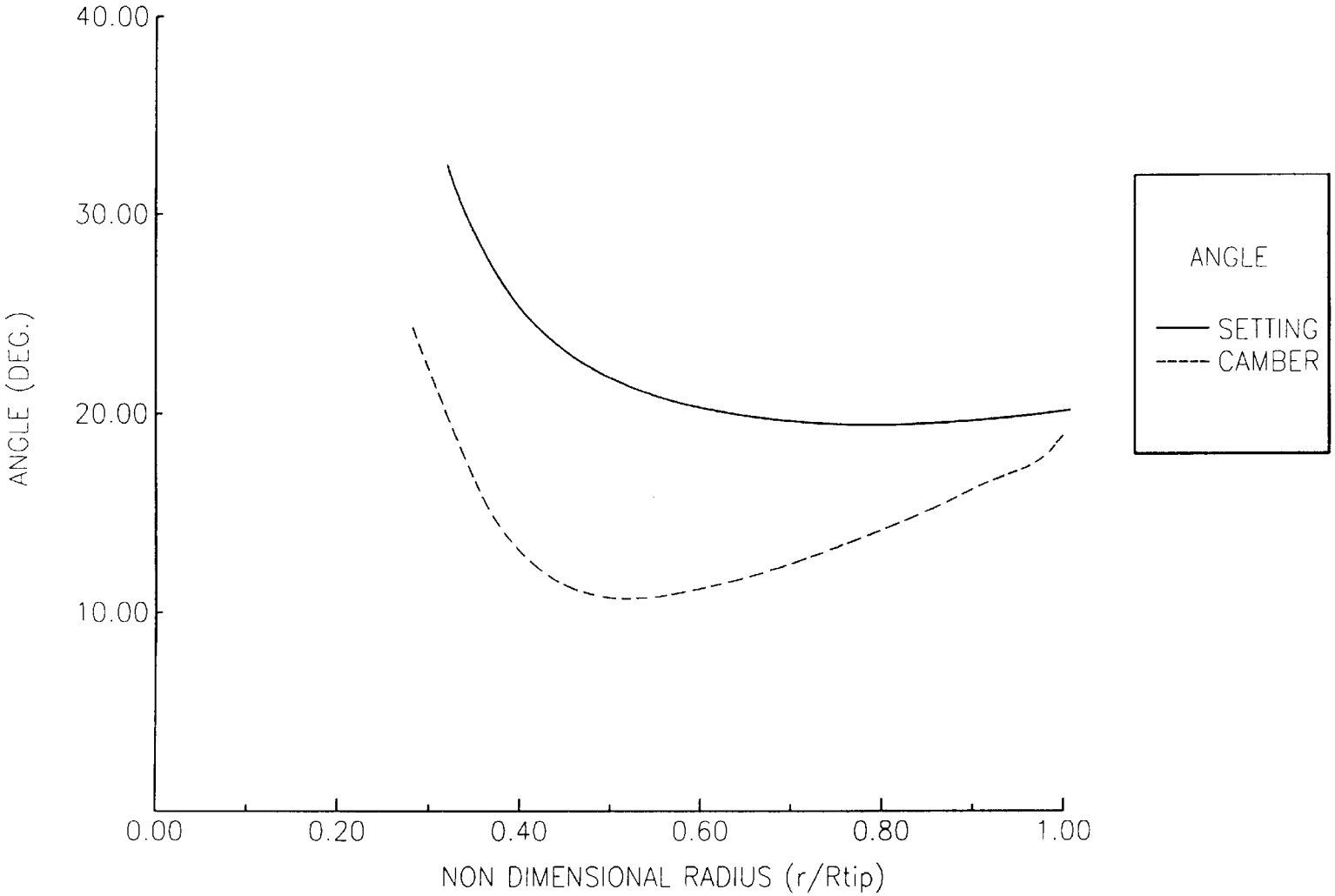
FIG. 8 is a graph indicating a non dimensional radius, the camber angle and the setting angle of the fan according to the present invention.

When a camber angle and a setting angle of a section of the free end of the blade 32 are respectively defined as indicated in FIG. 7, in conditions in which airflow volume is the same, the result of measuring the camber angle and the setting angle of the blade with respect to the fan according to the present invention is shown in FIG. 8. As a result, the camber angle of the blade 32 is preferably within a range of 20°–10° and the setting angle which is an inclination angle of the blade with respect to the rotation direction is preferably within a range of 18°–22°.

Also, a flange 33*a* is formed on the circumferential surface of the air inflow side (Si) of the band 33 bent and extending from the air inflow side (Si) toward the air outflow side (So). Alternatively, the flange can be formed on the circumferential surface of the air outflow side (So) of the band 33.

Referring to FIG. 4 again, the shroud 50 includes a housing portion 51 for housing the band 33 coupled to the free end of the blade 32 and a guide portion 52 formed extending from an air inflow side of the housing portion 51. On the inner surface of the housing portion 51, an airflow guide portion 51*a* for guiding the flow of air may be formed to be adjacent to the flange 33*a* from the air outflow side (So) toward the air inflow side (Si).

Figure 6:
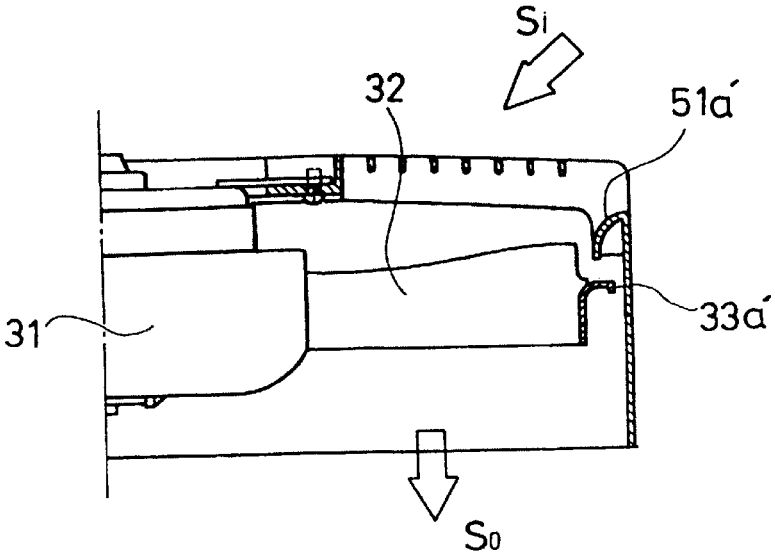
FIG. 6 is a sectional view of the shroud of FIG. 5.
Figure 5:
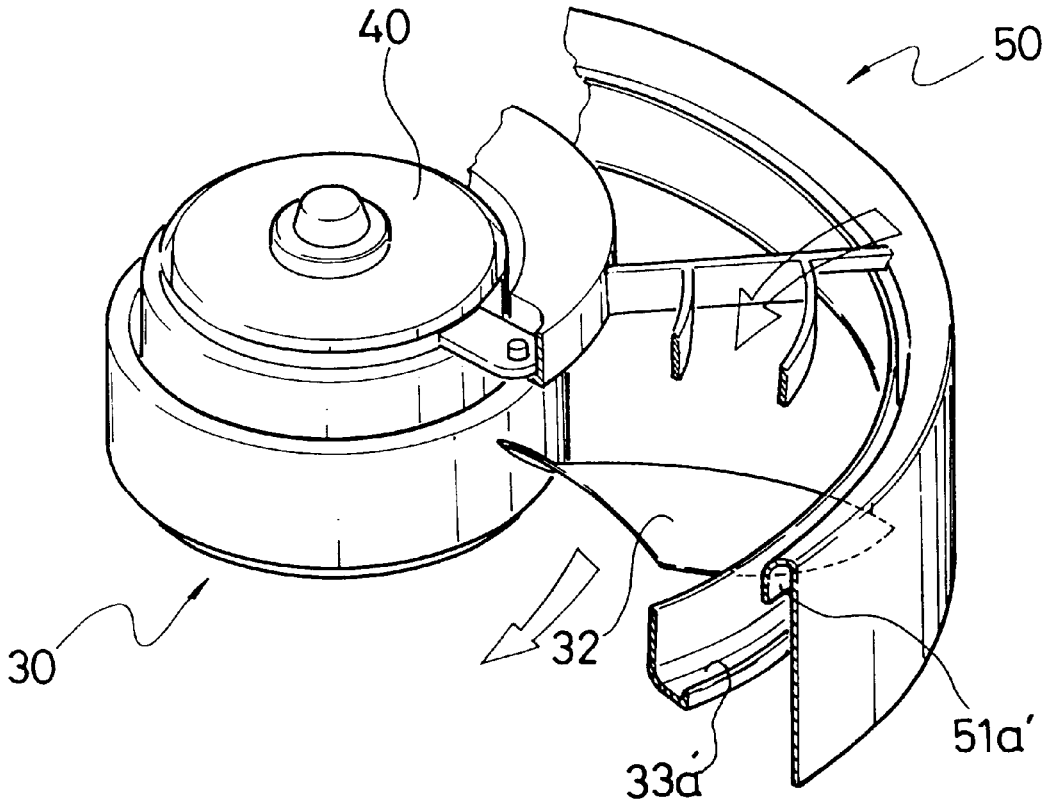
FIG. 5 is a perspective view illustrating a portion of the shroud assembly according to another preferred embodiment of the present invention.

According to another preferred embodiment of the present invention, as shown in FIGS. 5 and 6, an airflow guiding portion 51*a*' may be formed to be adjacent to the flange 33*a*' from the air inflow side (Si) toward the air outflow side (So).

As the housing portion, the air flow guiding portion, and the guide portion above, any structure for minimizing resistance to air inflow and preventing the backflow of air can be adopted.

The operation of the shroud assembly adopting a fan having the above structure according to the present invention will now be described.

As the driving shaft 41 of the motor 40 shown in FIGS. 3 and 4 rotates, air flows from the air inflow side (Si) toward the air outflow side (So) by the blades 32 inclined a predetermined degree with respect to the rotation direction of the fan 30. Here, the airflow generated by the blades 32 has an axial component, a rotational component, and a radial component as described above. However, since the ratio between the axial component and the radial component varies according to parts of the blade 32, the angle of the generated airflow varies accordingly depending on each part of the blade.

In such a process, since the tip portion of the leading edge 32*a* of the blade 32 is off from the housing portion 51 of the shroud 50 protruding toward the air inflow side (Si), interference with the housing portion 51 is reduced and thus the generation of noise decreases. That is, since the housing portion 51 of the shroud 50 is positioned out of the boundary of a vortex generated at the leading edge 32*a* of the free end of the blade 32, the generation of noise due to rotational interference can be prevented.

Furthermore, since the leading edge 32*a* of the free end of the blade 32 which is not coupled to the band 33 allows air to effectively flow inward in the radial direction and the axial direction of the shroud 50, the performance of the fan improves.

The band 33 coupled to the free end of the blade 32 reduces abnormal noise generated due to interference between the air of the rotational component and the radial component due to the trailing edge 32*b* and the housing portion 51, and also prevents the backflow of air blown from the air inflow side (Si) toward the air outflow side (So), thus improving the airflow efficiency. Also, since the band has a narrower width compared to the conventional fan, less material for the band can be used.

Figure 9:
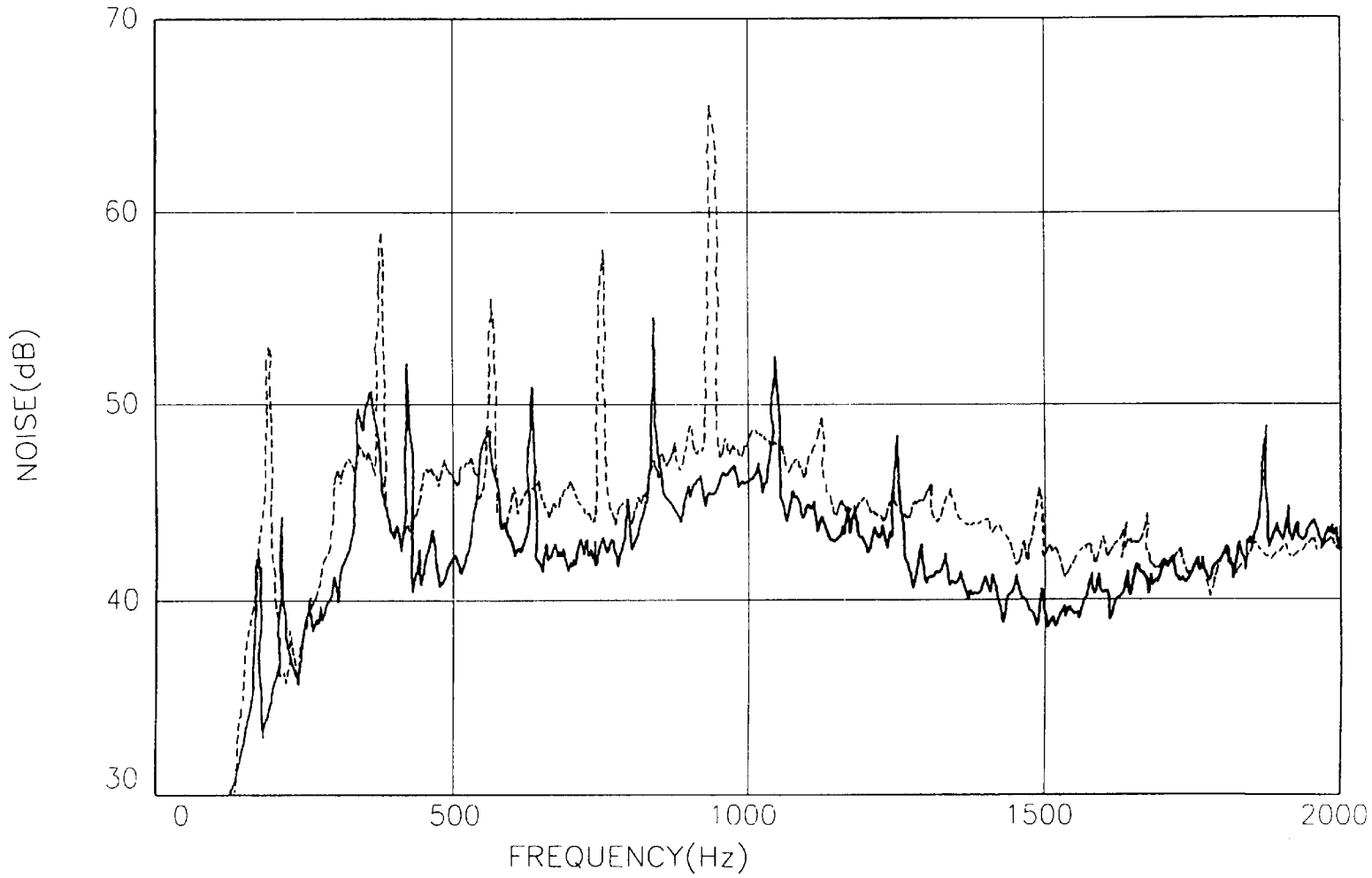
FIG. 9 is a graph indicating the noise according to a blade passing frequency of the shroud assembly of the present invention.

FIG. 9 shows the result of experiments by the present applicant measuring noise according to BPF between the fan of the present invention and the conventional fan under conditions of a particular consumption power and a particular airflow volume. As shown in the graph, the fan of the present invention (indicated by a solid line) can reduce interference noise by about 2 dB–5 dB compared to the conventional fan (indicated by a dotted line).

Figure 10:
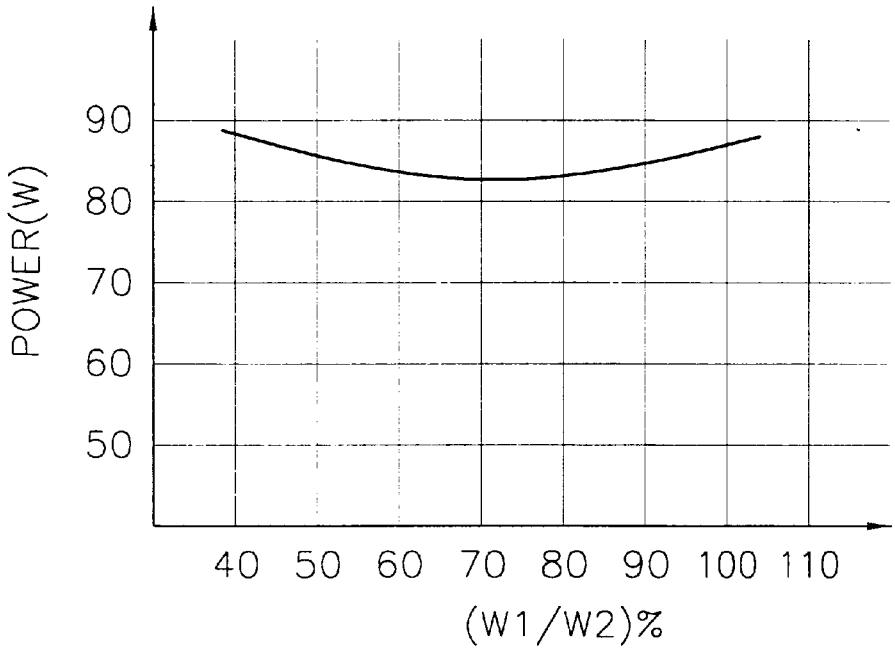
FIG. 10 is a graph indicating the relationship between consumption power and band width in the shroud assembly adopting the fan according to the present invention.

The graph of FIG. 10 indicates power consumption according to the axial direction-width W1 between the leading edge 32*a* and the trailing edge 32*b* at the free end of the blade 32 and the band-width W2. As shown in the graph, the power consumption of the motor decreases when W2 is in a rage of $0.5W1 \leqq W2<1.0W1$. In particular, when the band-width W2 is within a range of $0.6W1 \leqq W2<0.8W1$, the least power is consumed.

Figure 11:
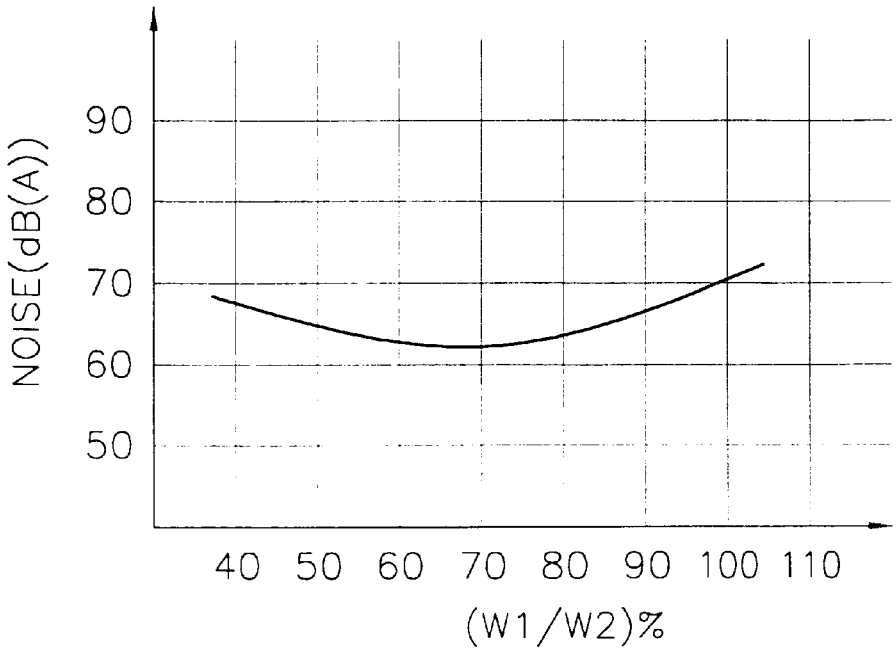
FIG. 11 is a graph indicating the relationship between noise and band width in the shroud assembly adopting the fan according to the present invention.

As shown in FIG. 11, noise also decreases when the band-width W2 is in a rage of $0.5W1 \leqq W2<1.0W1$. In particular, when the band-width W2 is within a range of $0.6W1 \leqq W2<0.8W1$, noise is reduced the most. Also, in the case of $W2<0.5W1$, a backflow of the air blown through a gap between the tip portion of the blade and the housing is generated to thereby lower the noise and the blowing efficiency.

It is noted that the present invention is not limited to the preferred embodiment described above, and it is apparent that variations and modifications by those skilled in the art can be effected within the spirit and scope of the present invention defined in the appended claims.

What is claimed is:

1. A fan comprising:

a hub coupled to a driving shaft of a motor;

a plurality of blades installed on the outer circumferential surface of said hub to be spaced from each other at a predetermined interval with a setting angle of a free end of each blade being within a range of 18°22°;

a band connecting the free ends of said blades and coupled to a trailing edge of the free end of each blade and having an axial direction width (W2) smaller than an axial direction width (W1) between a leading edge and a trailing edge of the free end of each blade and at least one-half the axial direction width (W1), the leading edge of the free end of each blade protruding from said band; and a flange extending outward from a circumferential portion of said band at one of an air inflow side and an air outflow side.

2. The fan as claimed in claim 1, wherein a relationship between said axial direction-width (W1) and said band-width (W2) is about $0.6W1 \leqq W2 < 0.8W1$.

3. A shroud assembly comprising:

a driving motor;

a fan having a hub coupled to a driving shaft of said motor, a plurality of blades installed on the outer circumferential surface of said hub to be spaced from each other at a predetermined interval with a setting angle of a free end of each blade being within a range of 18°–22°, a band connecting the free ends of said blades and coupled to a trailing edge of the free end of each blade and having an axial direction width (W2) smaller than an axial direction width (W1) between a leading edge and a trailing edge of the free end of each blade and at least one-half the axial direction width (W1), the leading edge of the free end of each blade protruding from said band, and a flange extending outward from a circumferential portion of said band at one of an air inflow side and an air outflow side; and a shroud supporting said driving motor and having a housing portion for housing said blades and said band.

4. The shroud assembly as claimed in claim 3, wherein a relationship between said axial direction-width (W1) and said band-width (W2) is about $0.6W1 \leqq W2 < 0.8W1$.

5. The shroud assembly as claimed in claim 3, further comprising:

an air flow guiding portion for guiding a flow of the air, extending from the inner surface of said housing portion toward said flange.

6. The shroud assembly as claimed in claim 3, further comprising a guide portion which extends from said housing portion.

* * * * *